US006834401B2

(12) United States Patent
Hatrick-Smith

(10) Patent No.: US 6,834,401 B2
(45) Date of Patent: Dec. 28, 2004

(54) PRE-PLUMBED SHOWER DOOR SYSTEM

(75) Inventor: John Hatrick-Smith, Glenfield (NZ)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/240,895

(22) PCT Filed: Apr. 4, 2001

(86) PCT No.: PCT/NZ01/00050

§ 371 (c)(1),
(2), (4) Date: Jan. 17, 2003

(87) PCT Pub. No.: WO01/74223

PCT Pub. Date: Oct. 11, 2001

(65) Prior Publication Data

US 2003/0145375 A1 Aug. 7, 2003

(30) Foreign Application Priority Data

Apr. 4, 2000 (NZ) ..... 503755

(51) Int. Cl.[7] ..... A47K 3/30
(52) U.S. Cl. ..... 4/614; 4/612
(58) Field of Search ..... 4/596, 612, 614

(56) References Cited

U.S. PATENT DOCUMENTS

| | | | | | |
|---|---|---|---|---|---|
| 1,112,200 A | * | 9/1914 | Dupont | ..... | 4/614 |
| 2,253,038 A | * | 8/1941 | Lee | ..... | 4/612 X |
| 5,070,549 A | | 12/1991 | Campe | ..... | 4/596 |

FOREIGN PATENT DOCUMENTS

| | | | | | |
|---|---|---|---|---|---|
| DE | 2707622 | * | 8/1978 | ..... | 4/614 |
| DE | 3738424 | * | 5/1989 | ..... | 4/612 |
| DE | 299 05 094 U | | 6/1999 | | |
| EP | 348653 | | 1/1990 | | |
| EP | 415058 | | 3/1991 | | |
| EP | 960592 | | 12/1999 | | |
| GB | 2026316 | * | 2/1980 | ..... | 4/596 |
| GB | 2129293 | | 5/1984 | | |
| WO | 200062656 | | 10/2000 | | |

OTHER PUBLICATIONS

Partial English language translation of DE 3,738,424, 4 pgs.*

International Search Report issued for Application No. PCT/NZ01/00050, 3 pgs.

International Preliminary Examination Report issued for PCT/NZ01/00050, 4 pgs.

Abstract of FR 2,702,138, Sep. 9, 1994, 1 pg.

* cited by examiner

*Primary Examiner*—Robert M. Fetsuga
(74) *Attorney, Agent, or Firm*—Quarles & Brady LLP

(57) ABSTRACT

A shower door system in knocked down from including: a door (4) and optionally one or more return panels (2, 3) for forming a shower enclosure, having a pre-installed shower mixer valve (14) mounted in a frame member (7) of the shower door system, a pre-installed shower rose (10) or shower rose connection fitting mounted in a frame member (7) of the shower door system and pre-installed plumbing from the mixer valve (9, 14), within a frame member (7) or members, to the shower rose (10) or shower rose connection fitting, so that when the shower door system is subsequently assembled and installed against a wall, or in a corner between two walls, to form a shower enclosure with a frame member (7) adjacent a wall, water supply plumbing to the shower (9, 10, 14) may pass from the wall directly to the frame member (7) to connect to the shower mixer valve (14).

10 Claims, 7 Drawing Sheets

PRE-PLUMBED SHOWER DOOR SYSTEM

This application claims the benefit of PCT/NZ 01/00050 filed 4 Apr. 2001 and further claims benefit to New Zealand Application No. 503755 filed 4 Apr., 2000.

FIELD

The invention comprises a shower door system which may be sold incorporating a mixer for the shower and a shower rose and associated plumbing pre-installed in frame members of the shower door system.

BACKGROUND

A shower door system including a door and return or in-fill panels on one or both sides of the door, is typically positioned against a wall in a bathroom or washroom or similar or in a corner between two walls, to form a shower enclosure. The complete enclosure comprises a shower base, the shower door system comprising a transparent or translucent glass or non-glass or opaque door and return or in-fill panel(s), and the wall or walls of the bathroom.

Typically to install the enclosure first hot and cold water pipes are plumbed into one of the bathroom walls to a mixer valve which is mounted in the wall, and a pipe from the mixer valve up to a plumbing fitting to receive a shower rose is installed. The shower base is fitted in position and then the wall lining and then the panels and door of the shower door system are installed, and then a fascia plate and control handle or knob of the mixer valve and the shower rose are fitted in position.

SUMMARY OF INVENTION

The invention provides an improved or at least alternative form of shower door system. The shower door system is intended to be sold in knocked down form incorporating a pre-installed mixer and shower rose or shower rose connection fitting.

In broad terms in one aspect the invention comprises a shower door system in knocked down form including a door and optionally one or more return panels for forming a shower enclosure, including a pre-installed shower mixer valve mounted in a frame member of the shower door system, a pre-installed shower rose or shower rose connection fitting mounted in a frame member of the shower door system, and pre-installed plumbing from the mixer valve, within a frame member or members, to the shower rose or shower rose connection fitting, so that when the shower door system is subsequently assembled and installed against a wall or in a corner between two walls to form a shower enclosure with a frame member adjacent a wall, water supply plumbing to the shower may pass from the wall directly to the frame member to connect to the shower mixer valve.

Preferably the knocked down shower door system also includes pre-installed plumbing from the mixer valve, within a frame member or members, and to the exterior of a face of a said frame member which will be adjacent a wall when the shower door system is assembled and installed.

BRIEF DESCRIPTION OF THE DRAWINGS

The invention is filter illustrated by the preferred forms thereof which are shown in the accompanying drawings by way of example and without intending to be limiting. In the drawings.

DETAILED DESCRIPTION OF PREFERRED FORMS

Figure 1:
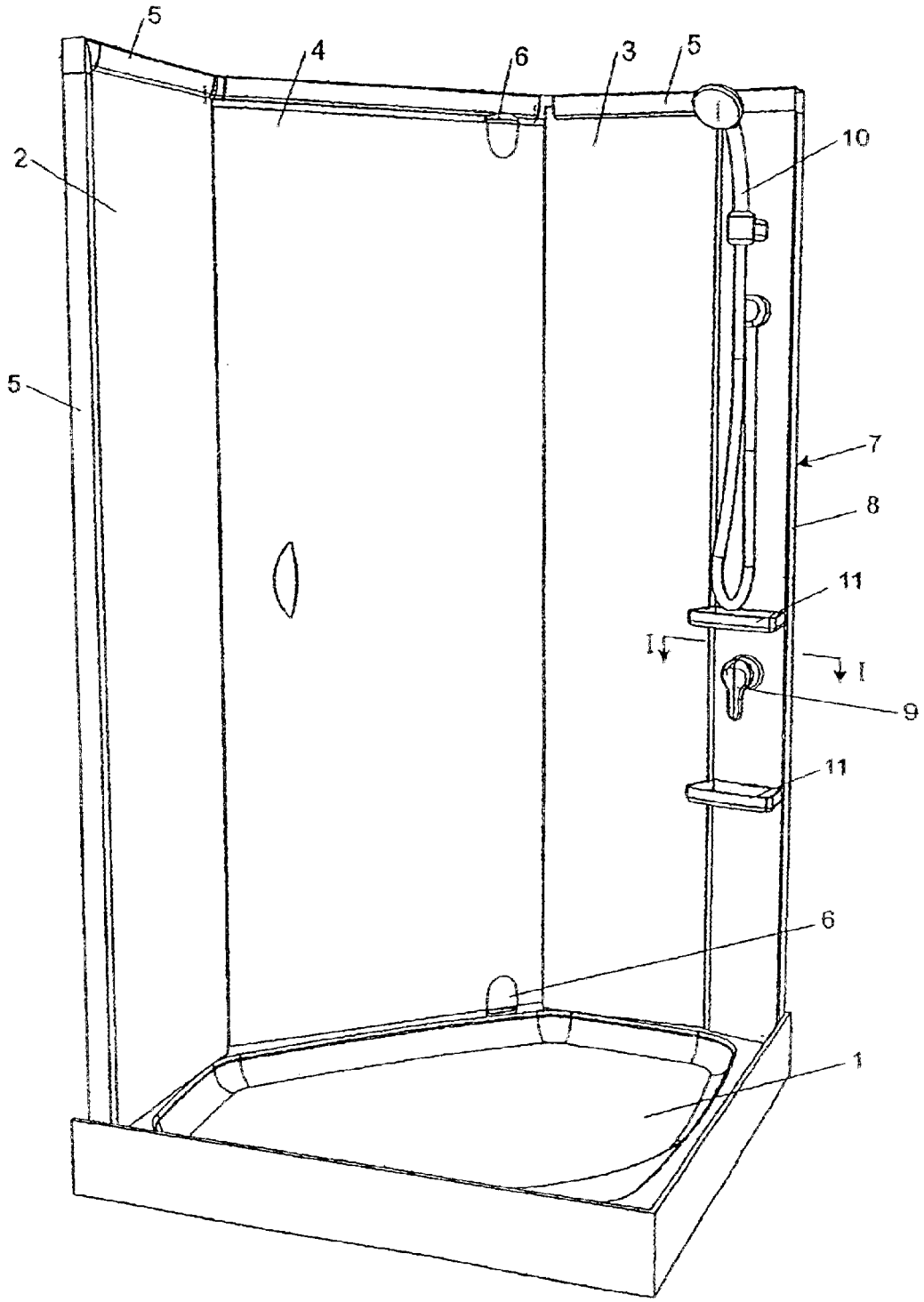
FIG. 1 is a view of one preferred form of shower door system of the invention from the interior.

The shower door system of FIG. 1 is shown on a shower base 1 and comprises return or in-fill panels 2 and 3 and a pivoting door 4, all of which are mounted within a frame 5 which is typically formed of extruded aluminium components. The door 4 comprises a panel mounted by pivots 6 so that the door may be opened outwardly of the enclosure. The door and return panels are typically formed from clear or translucent glass but may be formed from a non-glass material such as polycarbonate for example or an opaque material.

On one side the shower door system incorporates a hollow vertical member 7 which also forms part of the frame of the shower door system. In a preferred form the hollow member 7 is formed by two vertically extending extruded aluminium components. The hollow member 7 extends from the shower base I to the top of the frame as shown, and along an inner side edge retains the vertical edge of glass panel 3. The face or edge 8 of the member 7 when the shower door system is assembled and installed in position will abut a wall of the bathroom in which the shower door system is installed to form a shower enclosure. The frame member 7 mounts on the interior side of the shower enclosure the control handle 9 or knob of a shower mixer valve, and a shower rose 10 which may be of any type. The member 7 may also optionally mount shelves and/or flannel hoops or rails 11.

Figure 4:
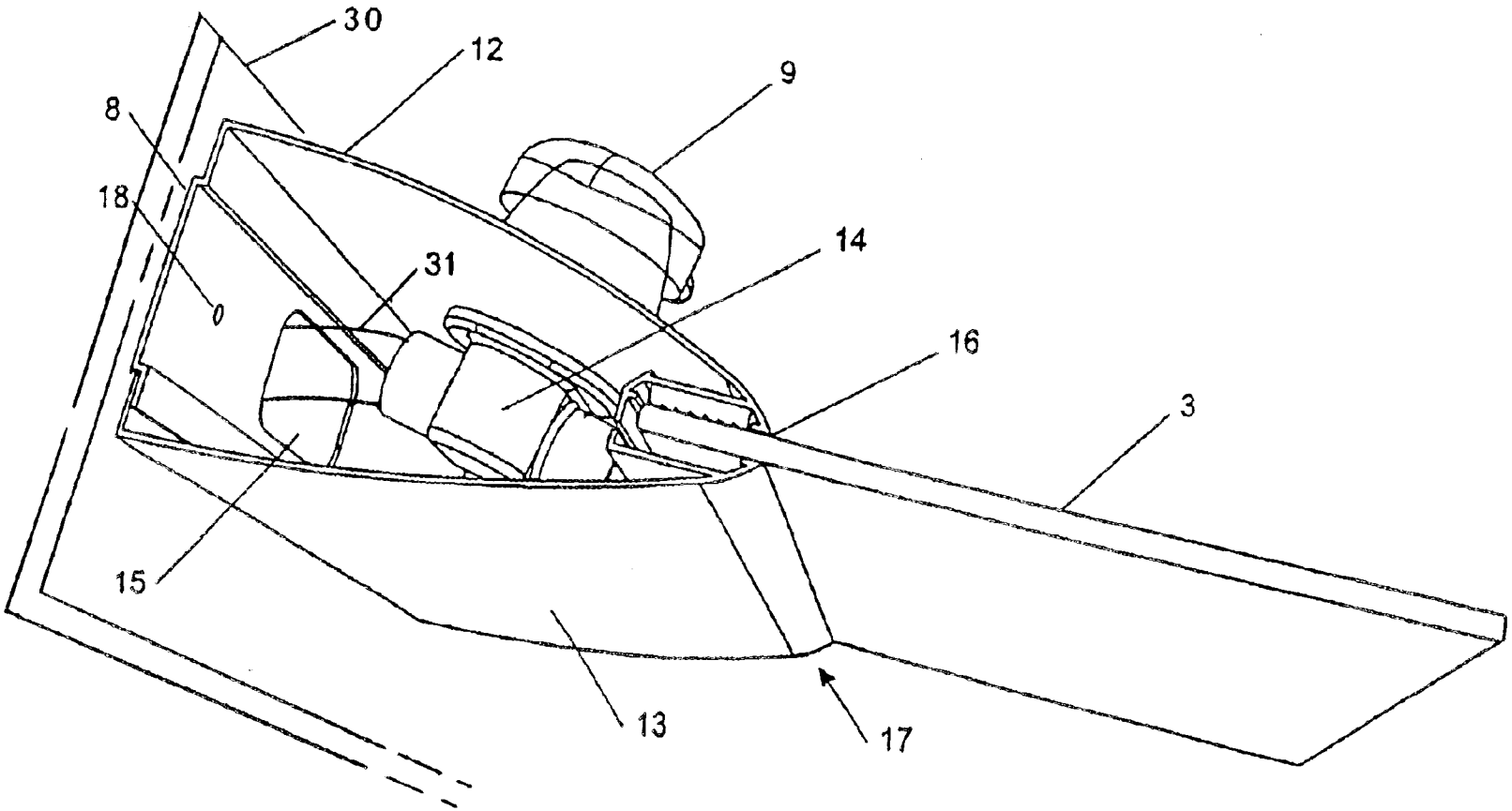
FIG. 4 is a cross-section view of one form of frame member formed by two extruded parts and in which a mixer valve is pre-installed.

FIG. 4 shows one form of such a hollow frame member 7 in cross section, which is formed by two longitudinally extended extrusions which may typically be aluminium extrusions but could alternatively be formed of a plastics material for example. One extrusion 12 forms the side or internal face of the hollow member 7 on the interior of the shower enclosure while the other extrusion 13 is on the exterior of the shower enclosure and forms the external face of the hollow member 7. The web which forms the side face 8 is formed on one of the extrusions as shown. The extrusions come together at the opposite edge 16 to retain the vertical edge of glass 3 panel 3 using a conventional rubber or plastic insert 17. Mixer valve 14 is positioned within the internal cavity of the frame member 7 and a pipe (not visible in FIG. 4) extends upwardly from the mixer valve 14 to a shower rose such as that indicated at 10 in FIG. 1, or shower rose connection fitting into which a shower rose may be screwed once the shower door system has been installed. An aperture 15 is provided in the side face 8 through which hot and cold water pipes 31 may pass directly from the bathroom wall 30 into the interior of the frame member 7 and to the mixer valve 14.

Typically to install the shower door system to form a shower enclosure first a shower base 1 is fitted in position, in the case of the shower door system shown in FIG. 1 in the corner between two walls of a bathroom or similar. A wet lining or tiling or similar is installed over the bathroom walls before or after the frame and glass panels of the shower door system are assembled and installed (or may be pre-existing within the bathroom or washroom). During installation of the glass panels and door and supporting frame the extrusion 12 including web 8 is secured to the wall by screwing through the web 8 into the wall surface framing behind the wall lining, through holes 18 (see FIGS. 4 and 5). At this stage the other half extrusion 13 of the hollow member 7 has not yet been installed, to allow access to the interior of the hollow member 7. In relation to plumbing in the bathroom wall it is necessary to provide only hot and cold water pipes which may pass through aperture 15 in the side face 8 of the frame member 7 to be coupled to the mixer valve 14. When installation of the shower door system is complete the other half extrusion 13 of the frame member 7 is fitted in place to complete the installation.

With the shower door system of the invention it is not necessary to fit a shower mixer and rose and plumbing between the mixer and rose into the wall of the bathroom before the wall is lined. Rather the shower mixer and rose and plumbing may be sold as part of the shower door system ready for installation, minimising what is subsequently required to install the shower door system on site.

Typically the shower door system will be sold in knocked down form including the hollow frame member 7 incorporating a pre-installed shower mixer and rose and associated plumbing within the cavity of the frame member 7. The associated plumbing will generally include a pipe from the mixer valve to the shower rose or at least a shower rose connection fitting, and may also optionally include flexible hot and cold water connection pipes from the shower mixer valve ready to be connected directly to hot and cold water pipes in the wall, for example. The mixer valve will typically have a control handle or knob such as that indicated at 9 in FIG. 4 fitted in place at the time of sale or the shower door system may simply be sold with the mixer valve pre-installed with instructions to the installer to fit the control lever or knob to the mixer valve, and optionally the shower rose, as one of the final steps of installation of the shower enclosure.

In the preferred forms shown the mixer is installed in a frame component which will lie adjacent and abut a wall when the shower door system is installed but this is not essential and in an alternative arrangement the mixer valve may be installed in a frame component of the shower door system which does not lie adjacent a wall in the installed enclosure, and the plumbing will then pass from the wall into and through one or more hollow fame members of the shower door system to the mixer valve. The shower rose or shower rose connection fitting may be mounted in the same frame member as the mixer valve or a different frame member.

Figure 5:
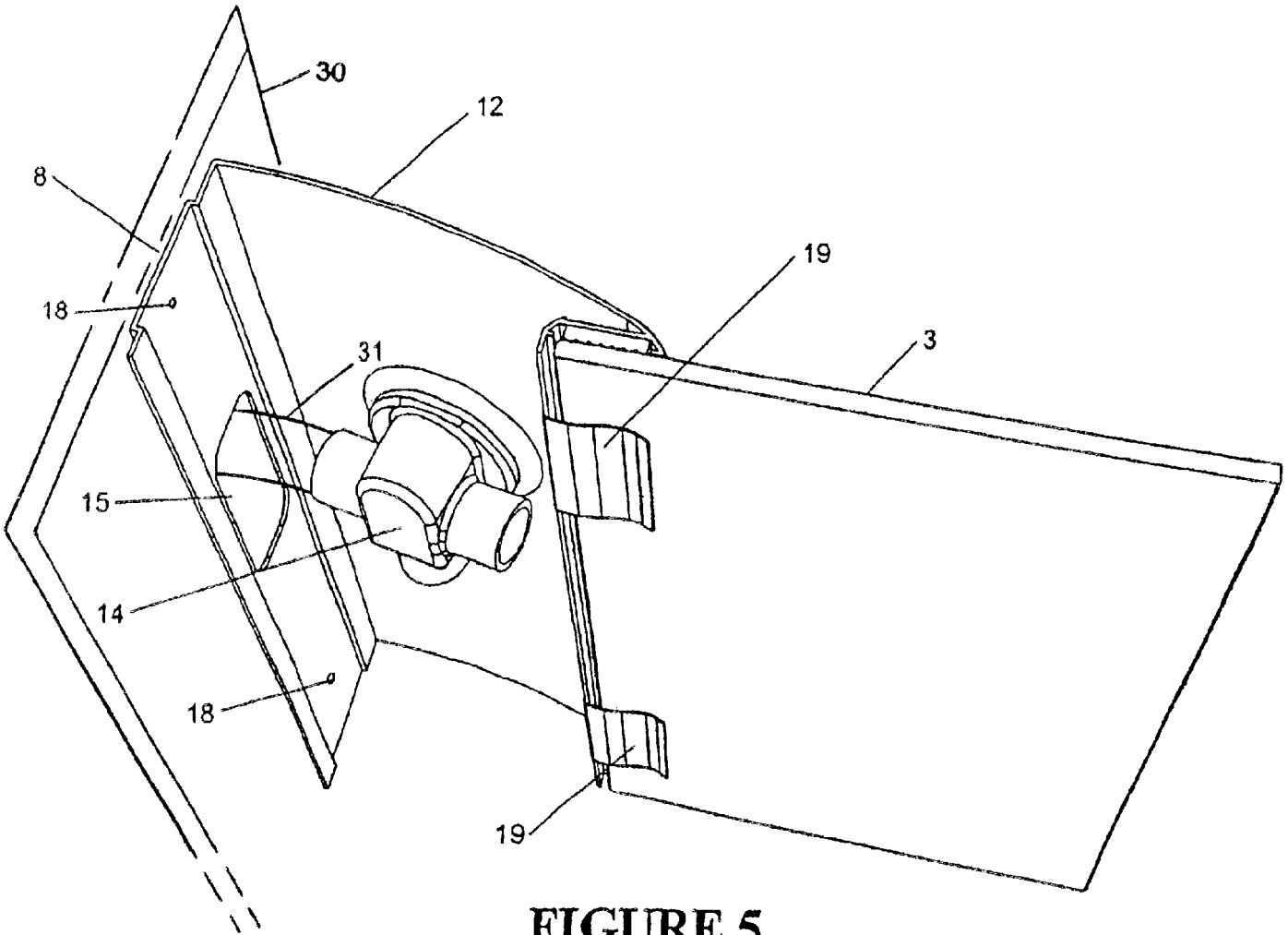
FIG. 5 is a view of the frame member of FIG. 4 but with one side of the frame member removed.

FIG. 5 is a view similar to FIG. 4 of the hollow member 7 of FIG. 4 but with the extrusion 13 removed, being that half extrusion which will normally form the side of the hollow member 7 on the exterior of the shower enclosure. In this embodiment the vertical edge of the glass panel 3 is fixed to the other half extrusion 12 by clips 19 which will securely retain the glass panel 3 in place prior to installation of the other half extrusion 13.

Figure 2:
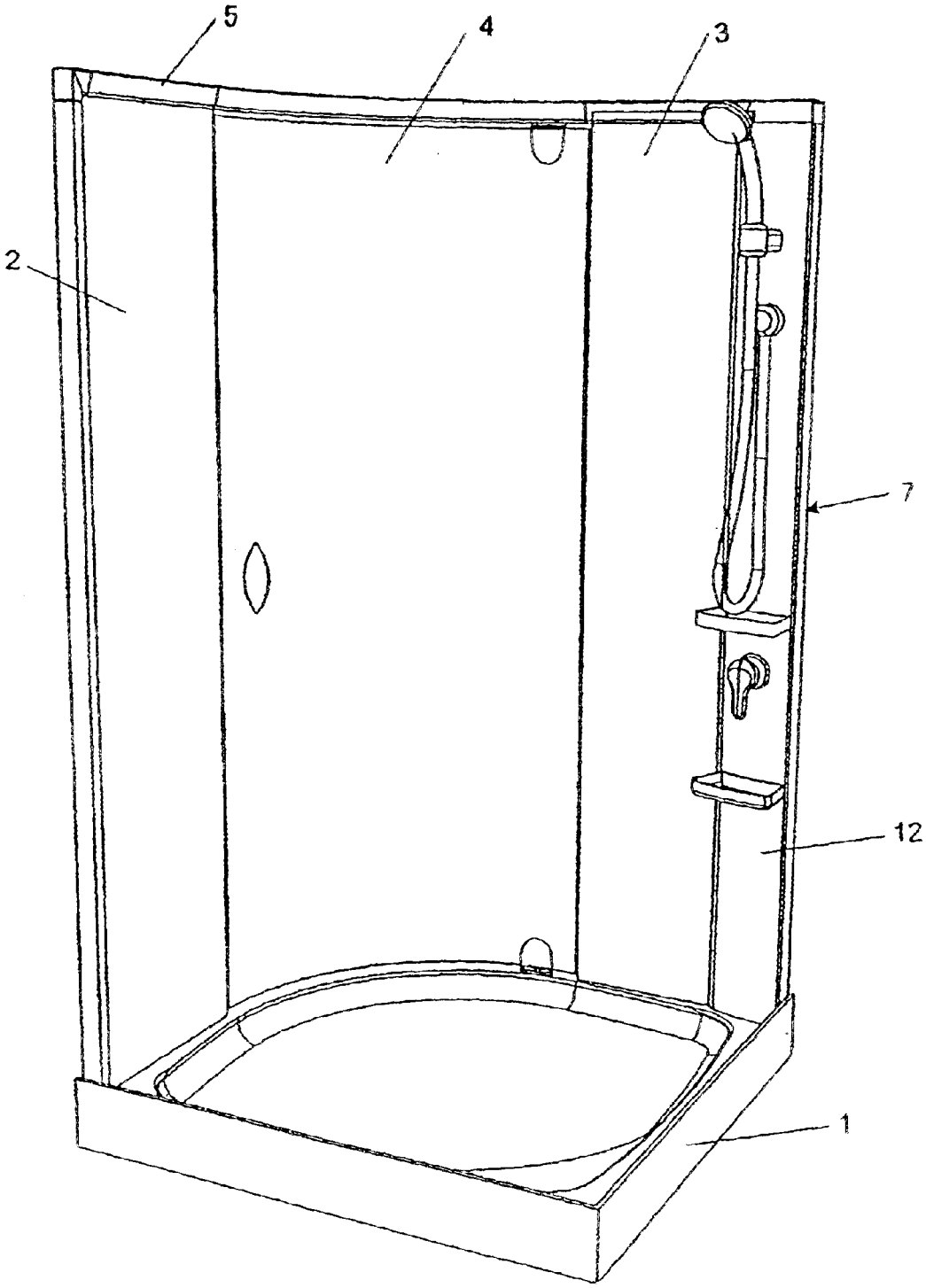
FIG. 2 is a view similar to FIG. 1 of another preferred form shower door system of the invention.

FIG. 2 shows another preferred form of shower door system which is largely identical to that of FIG. 1 except that the door 4 is curved as shown.

Figure 3:
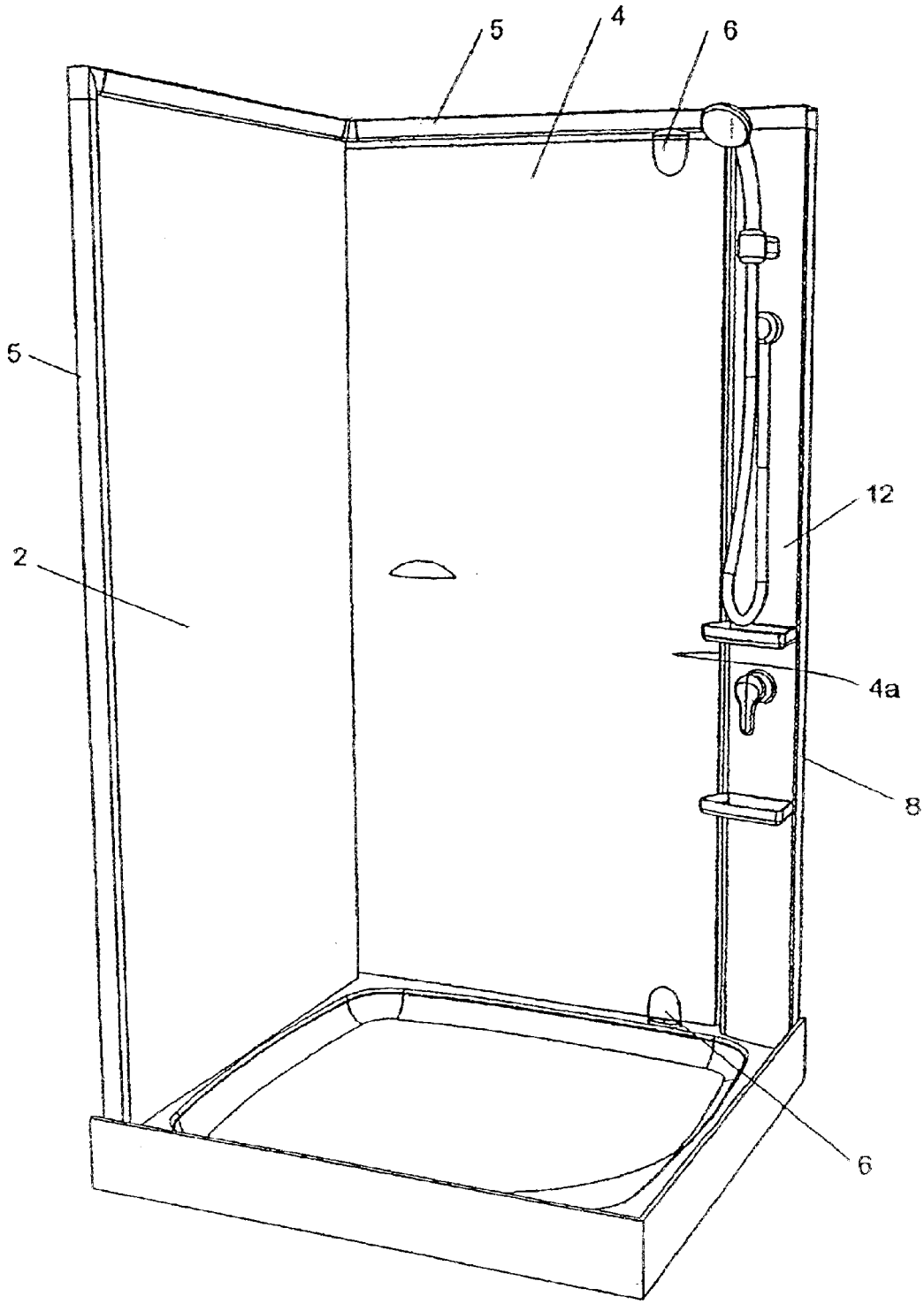
FIG. 3 is a view similar to FIGS. 1 and 2 of a further preferred form shower door system of the invention.

FIG. 3 shows a further form of shower door system of the invention which is again very similar to that of FIG. 1 except that the shower door system of FIG. 3 is square in shape and comprises door 4 and return wall 2. The door is pivoted at 6 and instead of retaining a vertical edge of panel 3 as in FIGS. 1 and 2, in the shower door system of FIG. 4 the inner vertical edge 16 of the hollow frame member 7 mounts a vertical seal against which the edge 4*a* of the door will seal when the door is closed.

Figure 6:
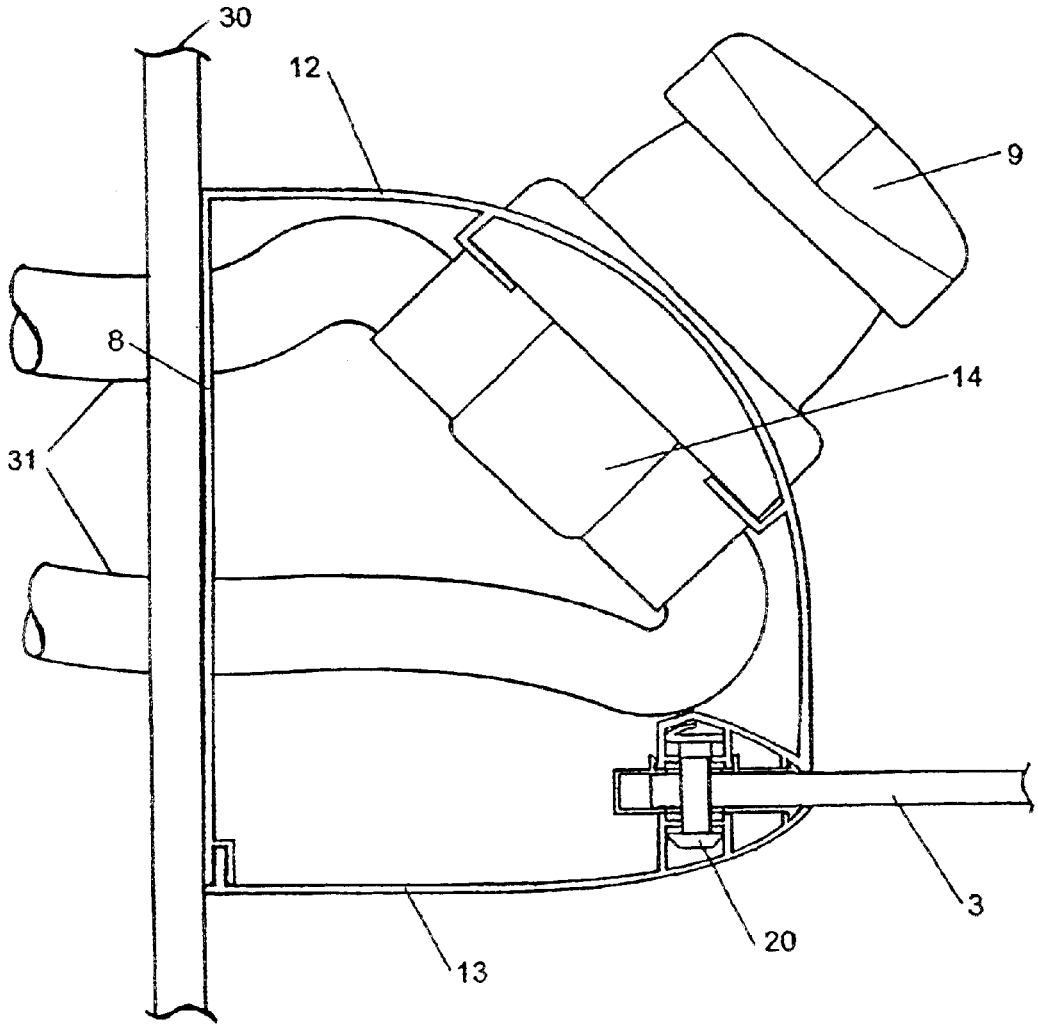
FIG. 6 is a cross-section view of another form of frame member formed by two extruded parts and in which a mixer valve is pre-installed.
Figure 7:
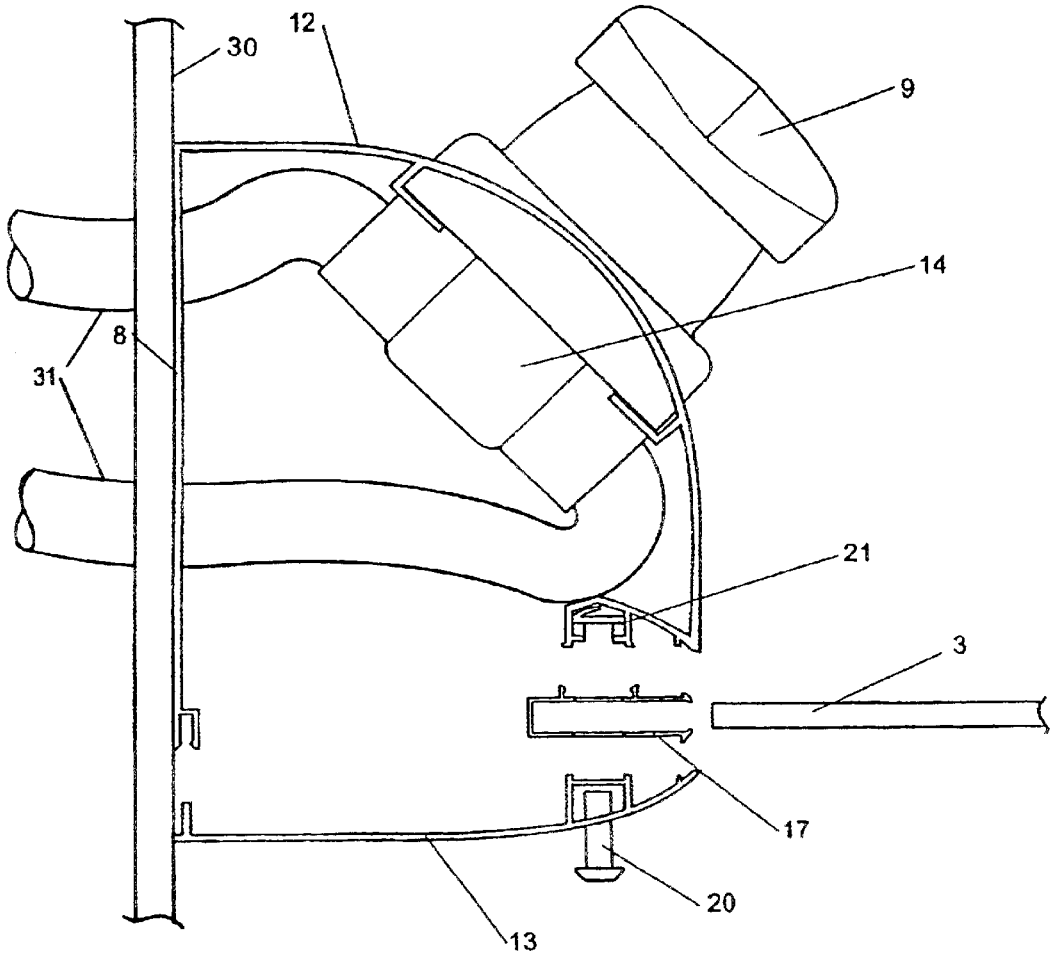
FIG. 7 is a cross-section view of the frame member of FIG. 6 in exploded form.

FIGS. 6 and 7 show in cross-section another form of frame member for a shower door system of the invention, in 2 assembled form in FIG. 6 and with parts exploded in FIG. 7. In FIGS. 6 and 7 in general similar reference numerals indicate similar parts as in FIGS. 4 and 5. This form of frame member is again composed of two longitudinally extending components which are typically extruded aluminium components, and which inter-engage when assembled together to form the frame member. The two extruded components may be designed so as to snap fit together but alternatively in the frame member structure of FIGS. 6 and 7 screw fastening components 20 spaced along the length of the extrusion pass through one half extrusion and thread into a female threaded part retained in a web 21 forming part of the other half extrusion. Again there are two half extrusions, one component 12 which forms the side of the frame member on the interior of the shower enclosure and another 13 which forms the side of the frame member on the exterior of the enclosure. The extrusions come together to retain the edge of a panel 3 via rubber or plastic insert 17. A face 8 of extrusion 12 will after installation of the shower door system lie adjacent a wall 30 and hot and cold pipes 31 may extend from the wall through an aperture in the face 8 and into the interior of the frame component to connect to the mixer valve 14. Alternatively in the knocked down shower door system for sale hot and cold connection pipes may be pre-installed which extend from the mixer valve 14 to or through an aperture in the face 8 or similar. In the embodiment of FIGS. 6 and 7 the component 2 which forms the interior side of the frame member is curved in shape as shown which conveniently orients the mixer so that the control handle or knob of the mixer faces into the interior of the installed shower enclosure as shown at an angle to panel 3 of the shower door system.

In the preferred forms described above the hollow frame member 7 which mounts the shower mixer and rose and internal plumbing is formed by two half extrusions which fit together to form the hollow frame member but alternative constructions are possible. For example the hollow member 7 could be formed of three extruded components and it is not necessary that the components forming the hollow member 7 be formed by extrusion or of aluminium and for example plastic or other materials may be used.

The foregoing describes the invention including preferred forms thereof and alterations and modifications as will be obvious to those skilled in the art are intended to be incorporated within the scope hereof as defined in the accompanying claims.

What is claimed is:

1. A shower door system ready for sale and installation, in assembled or knocked down form, including a hollow member at one side for mounting a mixer for the shower and a shower rose and so positioned that when the assembled shower door system is installed against a wall or in a corner between two walls, the hollow member will be adjacent a wall so that water supply plumbing to the shower may pass from the wall directly into the interior of the hollow member to connect to the shower mixer, the said hollow member also being a frame member of the shower door system and extending generally vertically for the full height of the shower door system and comprising an external face, an internal face within the interior of the enclosure, and a side face which will lie adjacent a wall when the shower door system is installed, and a face or edge opposite the side face which retains an edge of a glass panel of the shower door system or provides a vertical seal for a door of the shower, said side face including an aperture through which said water supply plumbing may pass into the interior of said frame member to connect to the shower mixer.

2. A shower door system according to claim 1 incorporating a pre-installed mixer valve and shower rose or shower rose connection fitting and associated plumbing pre-installed in said hollow frame member.

3. A shower door system in knocked down form including a door and optionally one or more return panels for forming a shower enclosure, including a pre-installed shower mixer valve mounted in a frame member of the shower door system, a pre-installed shower rose or shower rose connection fitting mounted in a frame member of the shower door system and coupled to the pre-installed shower mixer valve, and pre-installed plumbing to the shower rose, so that if the shower door system is subsequently assembled and installed against a wall to form a shower enclosure with a frame member adjacent a wall, water supply plumbing to the shower may pass from the wall directly to the frame member to connect to the shower mixer valve, said frame member which will be adjacent a wall when the shower door system is assembled and is so installed including an external face, an internal face towards the interior of the enclosure, one side face which will then lie adjacent a wall if the shower door system installed, and a face or edge opposite said one side face and which is adapted to retain an edge of glass or non-glass panel of the shower door system or which provides a vertical seal for a door of the shower, said one side face including an aperture through which said water supply plumbing to the shower mixer valve may pass into said frame member.

4. A shower door system according to claim 3 also including a pre-installed plumbing from the mixer valve, within a frame member or members, and to the exterior of a face of said frame member which will be adjacent a wall when the shower door system is assembled and installed.

5. A shower door system according to claim 3 wherein the mixer valve is mounted in said frame ember which will be adjacent a wall when the shower door system is assembled and installed.

6. A shower door system according to claim 3 wherein the mixer valve is mounted in said frame member which will be adjacent a wall when the shower door system is assembled installed, with an orientation such that the mixer control handle or knob will face into the interior of the shower enclosure at an angle to a panel of the shower door system which is retained by said frame member.

7. A shower door system according to claim 3 wherein the mixture valve and the shower rose or shower rose connection fitting are both mounted in said frame member which will be adjacent a wall when the shower door system is assembled and installed.

8. A shower door system according to claim 3 wherein the or each frame member(s) in which the pre-installed mixer valve and shower rose or shower rose connection fitting are mounted comprise two longitudinally extending parts which are assembled together to form the frame member.

9. A shower door system according to claim 3 wherein when assembled and installed provides a door, and a return wall which extends at an angle to the door.

10. A shower door system according to claim 3 wherein when assembled and installed provides a door and return walls on either side of the door.

* * * * *

UNITED STATES PATENT AND TRADEMARK OFFICE

CERTIFICATE OF CORRECTION

PATENT NO. : 6,834,401 B2
DATED : December 28, 2004
INVENTOR(S) : John Hatrick-Smith It is certified that error appears in the above-identified patent and that said Letters Patent is hereby corrected as shown below:

Column 1,
Line 62, "filter" should be -- further --.

Column 2,
Line 34, "base I" should be -- base 1 --.

Column 3,
Line 52, "fame" should be -- frame --.

Column 4,
Line 12, "2 assembled" should be -- assembled --.

Signed and Sealed this

Seventeenth Day of May, 2005

JON W. DUDAS
*Director of the United States Patent and Trademark Office*